United States Patent [19]

Theobald et al.

[11] 4,027,716

[45] June 7, 1977

[54] METHOD FOR PREPARING A CONTINUOUS CASTING BELT

[75] Inventors: Reiner Theobald, Frankfurt am Main; Ulrich Heubner, Bad Homburg, both of Germany

[73] Assignees: Metallgesellschaft Aktiengesellschaft, Frankfurt am Main, Germany; Schweizerische Aluminium AG, Zurich, Switzerland; part interest to each

[22] Filed: Mar. 7, 1975

[21] Appl. No.: 556,311

[30] Foreign Application Priority Data

Mar. 11, 1974 Germany ..... 2411448
May 6, 1974 Germany ..... 2421801

[52] U.S. Cl. ..... 164/19; 164/72; 164/138; 428/469; 164/87; 164/33

[51] Int. Cl.[2] ..... B22C 3/00; B22D 11/06

[58] Field of Search ..... 164/267, 278, 72, 73, 164/74, 75, 99, 100, 101, 33, 138, 87, 19, 29; 427/135; 29/195; 428/469

[56] References Cited

UNITED STATES PATENTS

| | | | |
|---|---|---|---|
| 2,100,258 | 11/1937 | Larson | 164/75 X |
| 2,611,163 | 9/1952 | Schaefer | 164/75 |
| 2,629,907 | 3/1953 | Hugger | 164/72 |
| 2,849,790 | 9/1958 | Zwicker | 164/100 X |
| 2,898,251 | 8/1959 | Treder | 164/75 X |
| 3,090,118 | 5/1963 | Hänzel | 164/75 |
| 3,180,022 | 4/1965 | Briggs | 164/75 UX |
| 3,186,045 | 6/1965 | Lagostina | 164/75 |
| 3,342,249 | 9/1967 | Ulmer | 164/72 |
| 3,450,189 | 6/1969 | MacDonald | 164/75 X |
| 3,461,944 | 8/1969 | Kuebrich | 164/75 X |
| 3,515,201 | 6/1970 | Zimmerman | 164/72 X |
| 3,779,816 | 12/1973 | Mao | 164/72 X |
| 3,795,269 | 3/1974 | Leconte | 164/278 X |
| 3,811,959 | 5/1974 | Weinstein | 428/469 X |
| 3,848,847 | 11/1974 | Komatsu | 164/72 X |
| 3,863,701 | 2/1975 | Niimi | 164/100 X |

*Primary Examiner*—Francis S. Husar
*Assistant Examiner*—John S. Brown
*Attorney, Agent, or Firm*—Karl F. Ross; Herbert Dubno

[57] ABSTRACT

A belt-type metal-casting machine comprises a metallic casting belt, preferably of steel, having its side turned toward the melt formed with a heat-lagging (thermal-insulating) layer upon which at least one abrasion-resistant cover layer is applied. The cover layer consists of one or more metals whose fusion temperature or melting point in Kelvin ° is equal to or greater than 0.7 times the melting temperature, in °K, of the casting metal to be applied.

8 Claims, 3 Drawing Figures

METHOD FOR PREPARING A CONTINUOUS CASTING BELT

FIELD OF THE INVENTION

The present invention relates to belt-type metal-casting machines and, more particularly, to a metal-casting machine having an improved belt, to an improved belt for a metal-casting machine, and to a method of operating a metal-casting machine of the belt type or to improvements in the casting of metal with belt-type casting machines.

BACKGROUND OF THE INVENTION

Belt-type casting machines have been provided heretofore and can include a pair of synchronously moving metal belts passing over driven and/or undriven rollers or drums and which define between them a gap into which molten metal is poured for progressive solidification as the casting is drawn by the belt from the liquidus zone. The belts are cooled by water or air and, downstream of the liquidus zone, a solidified casting is recovered. The belts generally lie at an inclination to the horizontal and the space in which the molten metal solidifies may be confined between a pair of lateral stationary or movable walls.

In order to obtain a satisfactory continuously cast strip, the codirectionally moving stretches of the belt (i.e. the upper and lower passes) which define the solidification space in the longitudinal and transverse directions, must form exactly planar surfaces. Such planarity can be readily achieved by making the belt very thick, but this has the disadvantage that the flexing ability of the belt is reduced and, as the belt repeatedly passes over the rollers and is subjected to cyclic bending stresses, deterioration of the belt occurs. Accordingly, the practice has been to provide casting belts of high-strength material under high tension.

Another requisite of the conventional belt-type casting system is that the belts must serve not only to impart the desired shape to the solidifying melt, but must also dissipate the latent heat of fusion so that solidification can occur. For this purpose the belts may be sprayed with a liquid coolant at their surfaces turned away from the continuous casting.

Because one side of the belt may be subjected to the coolant temperature while the other side is subjected to the melt temperature, the belts of conventional system tend to undergo differential thermal expansion such that adequate tensioning of the belts cannot be guaranteed.

It will be apparent that a continuous casting apparatus will have value only if the wear of the belt is minimized and need not require frequent replacement. It has already been proposed to provide a steel belt for a continuous casting system with a heat-lagging coating or thermally insulating layer so that a thermal resistance is provided across the belt and wear of the latter is reduced. However, since in prior systems the coating was abraded by the casting metal, the belts were not entirely satisfactory. The coatings must not only be temperature-resistant (refractory), heat-lagging (thermally insulating), flexible and tough, they must also adhere preferentially to the substrate metal of the belt rather than to the casting metal and must have a high tearing strength.

Some of the coatings which have been provided heretofore are dispersions of finely divided refractory material, such as diatomaceous earths, to which finely divided carbon, for example, graphite, is added. The dispersion is provided in an aqueous or alcohol solution containing solubilized organic binder, the solvent being evaporated after the dispersion has been coated onto the belt. To improve adherence to the belt, the substrate metal is roughened by sandblasting with corundum or by steel-shot peening. This insures a mechanical interlock between the coating and the steel substrate at the interface.

It has long been recognized in belt-type metal-casting apparatus, that some relative movement between the casting and the belt surface will occur. This relative movement results in abrasive wear of the heat-lagging coating and such coatings, where they do not resist abrasion, must be replaced or renewed frequently at considerable cost.

Another disadvantage of the conventional systems is that abrasive material from the coating frequently becomes entrained by the casting so that particles remain during subsequent rolling processes or leave a surface which does not roll effectively. Accordingly, the rolled products which are made from the continuous casting can have low quality.

There has also been described the application of a pulverulent parting agent such as talc, on an organic coating during operation of the casting belts. The parting agent serves to reduce the abrasive wear of the coating by preventing the casting from adhering to the coating material. The disadvantage of this arrangement is that the parting agent must be continuously removed whereby wear of the coating occurs and at least some particles of the parting agent remain entrained by the cast strip and are firmly locked into its surface.

Systems in which the casting bands are coated with ceramic materials provide an especially effective heat lag or thermal insulation, but these materials have little abrasion resistance since the coating, because of its brittleness, has a tendency to break down into fine particles which contaminate the surface of the cast strip.

When the belt-type casting machine is provided directly upstream of one or more rolling stands so that the residual heat of the casting can be used for the rolling process, the abrasive particles must be removed before the casting encounters the first rolls.

This is extremely difficult because of the high ductility of the continuous casting which limits mechanical removal of the particles. A material-removal technique, as is necessary to eliminate the particles, causes a significant loss of metal with significant economic disadvantages. Finally any attempt to flush the abraded particles from the surface by gaseous or liquid fluids removes only the loose particles and is ineffective against those particles which are firmly embedded in or bonded to the surface.

OBJECTS OF THE INVENTION

It is, therefore, the principal object of the present invention to provide a metal-casing belt for a belt-type casting machine, which has a heat-lagging or thermally insulating coating but which does not give rise to the disadvantages enumerated above.

Another object of the invention is to provide a casting belt of a belt-type casting machine having a heat-lagging coating which is temperature-resistant and flexible, has a high tearing strength, has excellent bonding characteristics with respect to the belt substrate, and has a particularly high abrasion resistance so that pickup of particles by the continuous casting from the coating is minimized or excluded.

Still another object of the invention is to provide an improved belt-type metal-casting machine which is more effective than earlier machines for continuous metal casting.

Still another object of the invention is to provide an improved process for casting a molten metal whereby the aforementioned disadvantages are obviated.

It is still another object of the invention to provide an improved method of operating a metal-casting machine so that the belts thereof have long useful lives and transfer of heat-insulating material from the belt to the continuous casting is minimized.

SUMMARY OF THE INVENTION

These objects are attained, in accordance with the present invention, by providing a belt having a substrate, e.g. of steel, a heat-lagging coating or layer upon and bonded to this substrate and, between the coating and the surface of the belt which engages the continuous casting, at least one abrasive-resistant cover coating consisting of one or more metals having a melting point in ° Kelvin which is equal to or higher than 0.7 times the melting point in ° K of the metal to be cast.

According to this melting point condition, where the metal to be cast has a melting point of 600° C (i.e. 873° K), the melting point of the protective coating overlying the heat-lagging or thermal insulating layer must have a melting point which is equal to or more than 0.7 × 873° K or 611.1° K, which corresponds to a melting point of 338° C or more.

It is indeed surprising that it is not at all essential that a cover coating have a melting point which is higher than that of the metal to be cast, as has been assumed for the metal of casting belts generally, and it is a significant aspect of our discovery, resulting from theoretical considerations and experiments, that the melting point of the cover coating can be less than the melting point of the continuously cast metal, as long as the cover coating has a melting point at least 0.7 times the melting point of the cast metal in ° K.

For instance, for the casting of aluminum with a melting point of 933° K, a metallic cover coating of zinc having a melting temperature of 692° K has been used most successfully. The ratio of the absolute melting temperatures in this case is greater than 0.7, i.e. is 0.74.

It has also been found to be advantageous from time to time to provide a plurality of cover coatings of different metals, each of which has a melting point at least 0.7 times the melting point of the continuously cast metal.

The heat-lagging coating can be any of those which have become conventional in the art, i.e. a thermally insulating layer of diatomaceous earth in which graphite is distributed and which is deposited from dispersion in an organic solution of, for example, acetone in which a phenolformaldehyde resin is dispersed as the organic binder.

The cover coating can then be applied to the heat-lagging coating without a binder, e.g. by flame-spraying, plasma-spraying or electrodeposition.

In the casting of aluminum strip, cover coatings are applied in a thickness of 30 to 500 microns preferably 50 to 200 microns, to the heat-lagging or thermally insulating coatings and consist of, for example, molybdenum, nickel, titanium, copper and iron and their alloys. The cover coating adheres very firmly to the heat-lagging coating which can have a thickness of 100 to 500 microns, coating thicknesses which were not hitherto obtainable because of the abrasive action with conventional casting belts. This casting belt according to the invention has a high abrasion resistance.

While the cover coating can be used with any conventional heat-lagging layer, it has been found to be most successful when the belt has a steel substrate, the heat-lagging material is a ceramic and the cover coat is one of the metals cited above.

The bond strength at the interface between the heat-lagging coating and the cover layer may be improved by applying an interlayer (transition layer) in the form of a mixture of the heat-lagging material and the cover-coat material.

An important advantage of the present system is that the heat-lagging or thermally insulating layer is protected completely by the cover coating and does not directly contact the continuous casting as it solidifies. This prevents pyrolytic destruction of any organic binder of the heat-lagging coating and thus prevents loosening of the cover layer or heat-lagging layer by reduction of the bond strength.

BRIEF DESCRIPTION OF THE DRAWING

The above and other objects, features and advantages of the present invention will become more readily apparent from the following description, reference being made to the accompanying drawing in which.

SPECIFIC DESCRIPTION AND EXAMPLE

Figure 3:
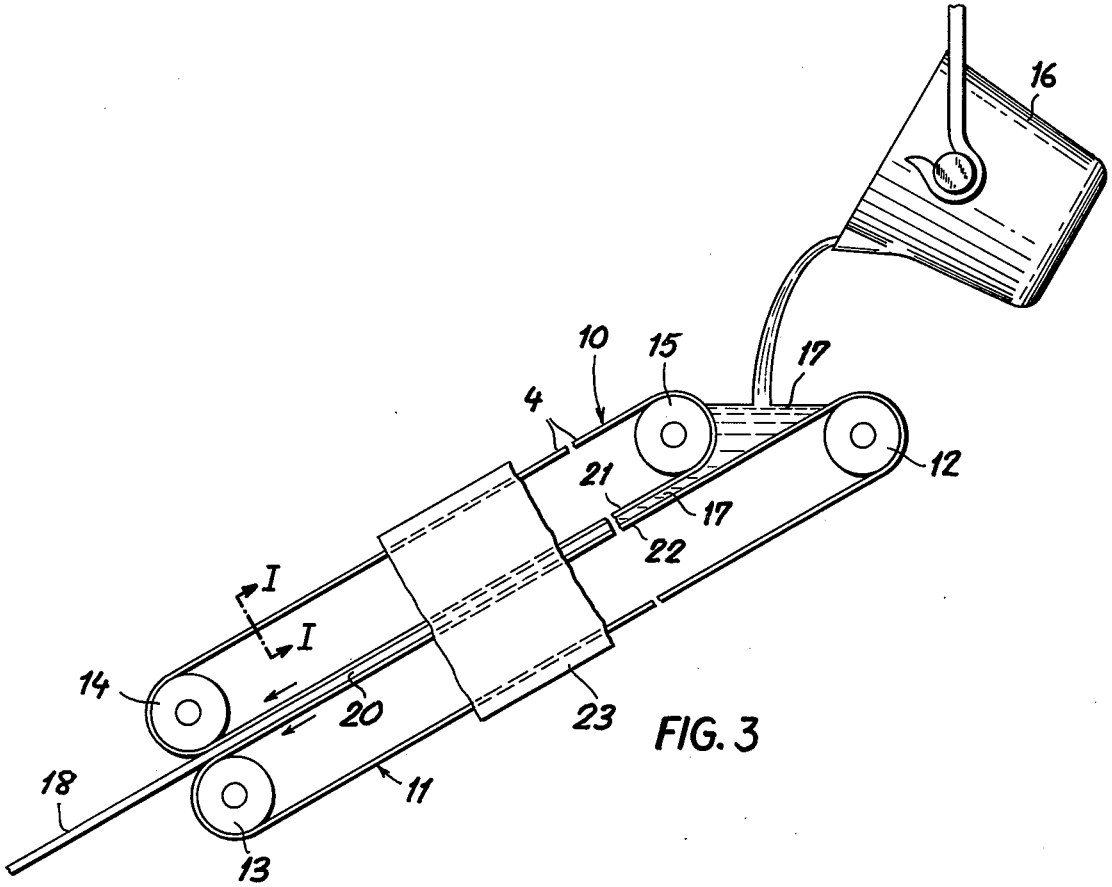
FIG. 3 is a diagrammatic view, partly broken away, of a continuous casting apparatus according to the invention.

Referring first to FIG. 3 it will be seen that a continuous casting machine according to the invention may comprise a pair of endless belts 10 and 11 defining a gap 20 between their codirectionally moving passes 21 and 22, the belt extending over driven and nondriven rollers 14, 15 and 12, 13 respectively. The means for driving the rollers, for tensioning the belts, for adjusting the gap between the passes 21 and 22 and for cooling the belts are conventional in the art and have not been illustrated. The space 20 is laterally defined between a pair of walls one of which has been shown at 23. A ladle 16 casts a stream of molten metal 17 into the gap between the rollers 12 and 15 and the molten metal continues to be entrained between the belts as it solidifies to a strip 18 which can be fed directly to a rolling mill.

Figure 1:
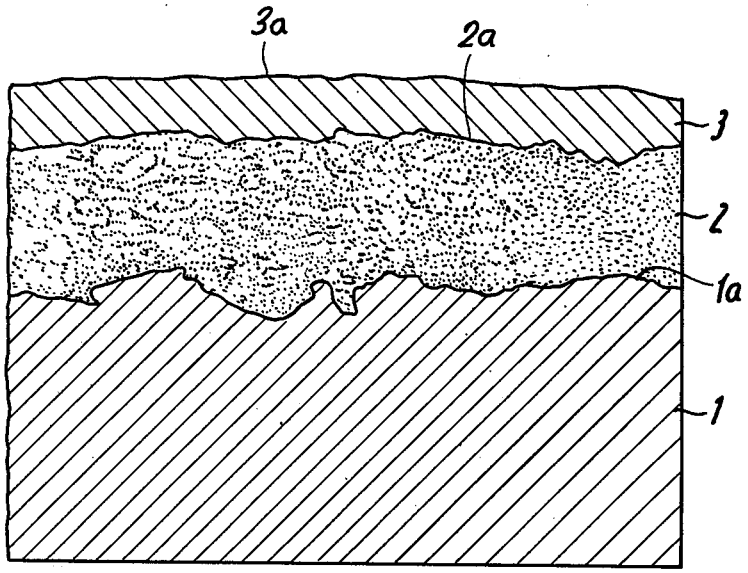
FIG. 1 is a cross-section through a belt of a continuous casting machine according to the present invention, as taken along the line I — I of FIG. 3.

As can be seen from FIG. 1, a suitable belt for the casting of a high melting point metal may comprise a substrate 1 of steel whose surface 1*a* is roughened as described and which is coated with a layer 2 of, for example, aluminum oxide to a thickness of 400 microns by flame-spraying. This leaves a rough surface 2*a* upon which a layer 3 of molybdenum can be deposited to a thickness of 100 microns to form the cover coating. This surface can be mechanically polished so that an abrasion-free engagement of the molten metal is achieved. The surface 3*a*, of course, engages the continuous casting.

Figure 2:
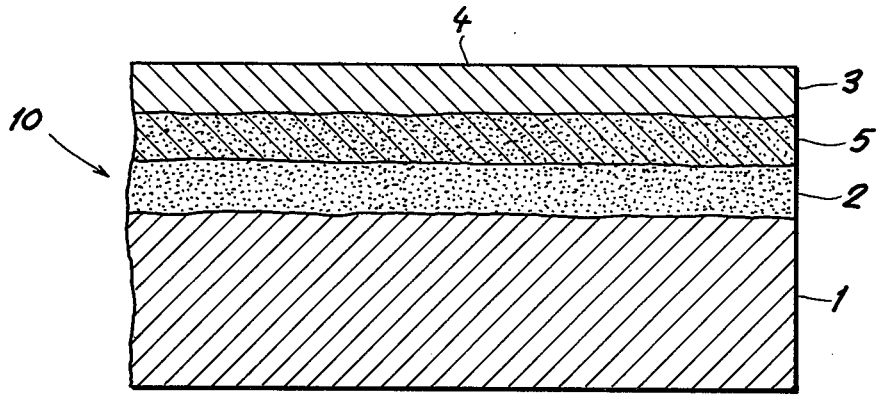
FIG. 2 is another embodiment of a belt according to the invention.

In FIG. 2 we have shown a belt for continuous casting which deviates from the embodiment illustrated in FIG. 1 only by having an interlayer of transition layer 5 of a mixture of aluminum oxide and molybdenum formed by spray-deposition before the molybdenum layer is applied.

In a specific case, molten iron at a temperature of about 1600° C is cast between belts of the type described in connection with FIG. 1 except that the molybdenum layer was replaced by a nickel layer.

We claim:

1. A method of making a pair of metal-casting belts for a continuous casting apparatus for use with a specific metal to be cast between them, comprising the steps of applying for each belt a heat-lagging layer on a belt substrate, and depositing at least one abrasion-resistant cover coating on said heat-lagging layer to form the casting-engaging surface of the belt, said cover coating consisting of at least one metal having a melting point in ° K at least equal to 0.7 times the melting point in ° K of the metal of the casting.

2. The method defined in claim 1 wherein said coating is applied in thickness of 30 to 500 microns.

3. The method defined in claim 2 wherein said coating is applied in a thickness of 50 to 200 microns.

4. The method defined in claim 1 wherein said coating is composed of a material selected from the group which consists of molybdenum, iron, titanium, nickel, copper and alloys and mixtures thereof.

5. The method defined in claim 1 wherein said coating is applied by flame-spraying, plasma-spraying or electro-depositing.

6. In a process for the continuous casting of a molten metal between a pair of continuous casting belts having codirectionally moving surfaces defining a casting-solidification gap between then, said belts having respective heat-lagging layers, the improvement which comprises applying to each of said belts to form the respective surface and cover the respective heat-lagging layer, a cover coating of a metal having a melting point in ° K which is at least 0.7 times the melting point in ° K of said molten metal.

7. A method of operating a metal-casting apparatus comprising advancing a pair of endless casting belts having a pair of codirectional stretches defining a gap between them, and pouring liquid molten metal into said gap to form a continuous casting, each of said belts being prepared by applying a heat-lagging layer on a belt substrate and depositing at least one abrasion-resistant cover coating upon said heat-lagging layer to form the casting-engaging surface of the belt, said cover coating consisting of at least one metal having a melting point in ° K at least equal 0.7 times the melting point in ° K of the metal of the casting.

8. A method of preparing continuous casting apparatus for use which comprises the steps of:

applying heat-lagging coatings to a pair of endless casting belts; and applying to said heat-lagging coatings, cover coatings of a metal and forming a pair of surfaces defining a casting solidification gap between them, displacing said surfaces codirectionally and depositing molten metal in said gap for solidification therein, said cover coatings having melting points in ° K at least equal to 0.7 times the melting point in ° K of said molten metal.

* * * * *